US008534181B2

(12) United States Patent
Zimmerman

(10) Patent No.: US 8,534,181 B2
(45) Date of Patent: Sep. 17, 2013

(54) SELF-LOADING FIREARM

(76) Inventor: David A. Zimmerman, Hermiston, OR (US)

( * ) Notice: Subject to any disclaimer, the term of this patent is extended or adjusted under 35 U.S.C. 154(b) by 194 days.

(21) Appl. No.: 13/011,538

(22) Filed: Jan. 21, 2011

(65) Prior Publication Data

US 2011/0185885 A1 Aug. 4, 2011

Related U.S. Application Data

(63) Continuation-in-part of application No. 11/093,715, filed on Mar. 29, 2005, now abandoned.

(51) Int. Cl.
*F41A 3/54* (2006.01)
*F41A 3/50* (2006.01)

(52) U.S. Cl.
USPC ..... 89/183; 89/175

(58) Field of Classification Search
USPC ..... 89/182, 183, 175
See application file for complete search history.

(56) References Cited

U.S. PATENT DOCUMENTS

| | | | | |
|---|---|---|---|---|
| 2,429,598 | A * | 10/1947 | Balleisen et al. | 89/194 |
| 2,732,768 | A * | 1/1956 | Browning | 89/182 |
| 2,774,283 | A * | 12/1956 | Harvey | 89/194 |
| 5,970,642 | A * | 10/1999 | Martin | 42/73 |
| 2006/0254112 | A1 * | 11/2006 | Snoderly | 42/74 |
| 2012/0137872 | A1 * | 6/2012 | Crommett | 89/193 |
| 2012/0304518 | A1 * | 12/2012 | Kerbrat et al. | 42/1.06 |

* cited by examiner

*Primary Examiner* — Stephen M Johnson
(74) *Attorney, Agent, or Firm* — Timothy E. Siegel Patent Law, PLLC; Timothy E. Siegel

(57) ABSTRACT

An automatic firearm that includes a unitary portion including a human interface and a barrel defining a longitudinal dimension. A slidable portion is attached to the unitary portion so as to permit the slidable portion to slide in the longitudinal dimension. The slidable portion includes at least a portion of a firing chamber. In addition, a lock is adapted to selectably fix the slidable portion relative to the unitary portion. Also, a chamber attached to the unitary portion and an inertial member permitted to move inside the chamber and urged into a first position, the inertial member adapted to translate into a second position, displaced from said first position by at least 0.1 cm, upon firing of the firearm, in which second position the inertial member begins to change the position of the lock, thereby permitting the moveable portion to move relative to the unitary portion.

14 Claims, 2 Drawing Sheets

SELF-LOADING FIREARM

RELATED APPLICATION

This application is a continuation-in-part of application Ser. No. 11/093,715, filed Mar. 29, 2005 now abandoned, which is hereby incorporated by reference as if fully set forth herein.

BACKGROUND OF THE INVENTION

In a recoil operated self-loading firearm the "recoil" motion caused by firing is harnessed to unlock a portion that moves relative to the handgrip (in the case of a hand gun) or buttstock (in the case of a rifle). This relative motion is used to eject the spent cartridge case and to load another cartridge into the firing chamber, from a stock of cartridges held in a magazine.

The unlocking of the two portions, however, cannot take place too quickly after firing the cartridge, because immediately after firing the barrel contains highly pressurized gas that would be dangerous if released prematurely. Too overcome this problem many mechanisms have been invented for unlocking the two firearm sections, after a short delay, to permit the bullet to leave the barrel and the barrel to depressurize.

Unfortunately, the mechanisms currently employed to use the recoil of the firearm in locked breech pistols all suffer from one or both of two drawbacks. First, for currently available mechanisms, the delay is inversely proportional to the intensity of the ordinance used. Accordingly, the need for a sufficient unlocking delay places an upper limit on ordinance intensity. Second, many unlocking mechanisms rely on a limited movement of the barrel of the firearm. Any structure in which the barrel of the firearm is not fixed to the part that is held by the operator has the potential for degrading shooting accuracy.

Also currently available, and employed particularly in self-loading rifles, is a mechanism by which the pressurized gas present in the gun barrel directly after a shot is fired is employed to eject the spent cartridge case and load an unfired cartridge into the firing chamber. Unfortunately, the complexity of this type of mechanism adds to the weight of the firearm and may be subject to jamming due to incompletely burned propellant powder granules that may be present in the system immediately after shooting. Although it appears that one handgun has been designed utilizing this scheme, it is so heavy as to have limited utility.

SUMMARY OF THE INVENTION

In a first, separate aspect the present invention is a self-loading firearm that includes a unitary portion including a human interface and a barrel defining a longitudinal dimension. A slidable portion is attached to the unitary portion so as to permit the slidable portion to slide in the longitudinal dimension. The slidable portion includes at least a portion of a firing chamber. In addition, a lock is adapted to selectably fix the slidable portion relative to the unitary portion. Also, a recess in the unitary portion and an inertial member permitted to move inside the recess and urged into a first position, the inertial member adapted to translate into a second position, displaced from said first position by at least 0.1 cm, upon firing of the firearm, in which second position the inertial member begins to change the position of the lock, thereby permitting the slidable portion to move relative to the unitary portion.

In a second separate aspect, the present invention is a set of firearms of differing calibers. Each of the firearms includes a unitary portion, including a human interface and a barrel and a moveable portion attached to the unitary portion so as to permit the moveable portion to move relative to the unitary portion, the moveable portion including at least a portion of a firing chamber. Each firearm also includes a lock-unlock mechanism for holding the unitary portion and the moveable portion together until after the firearm is fired and an unlocking delay has passed. Each of the lock-unlock mechanisms is of essentially identical design except for being modified to produce a sufficient unlocking delay for the firearm caliber. Moreover, the essentially identical design is capable of being slightly modified to produce an unlocking delay of sufficient length for a firearm of any caliber.

In a third separate aspect, the present invention is a self-loading handgun comprising a barrel and a handgrip and in which the barrel is rigidly and permanently attached to the handgrip, so that there is never any relative motion between the barrel and the handgrip.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENT(S)

Figure 1:
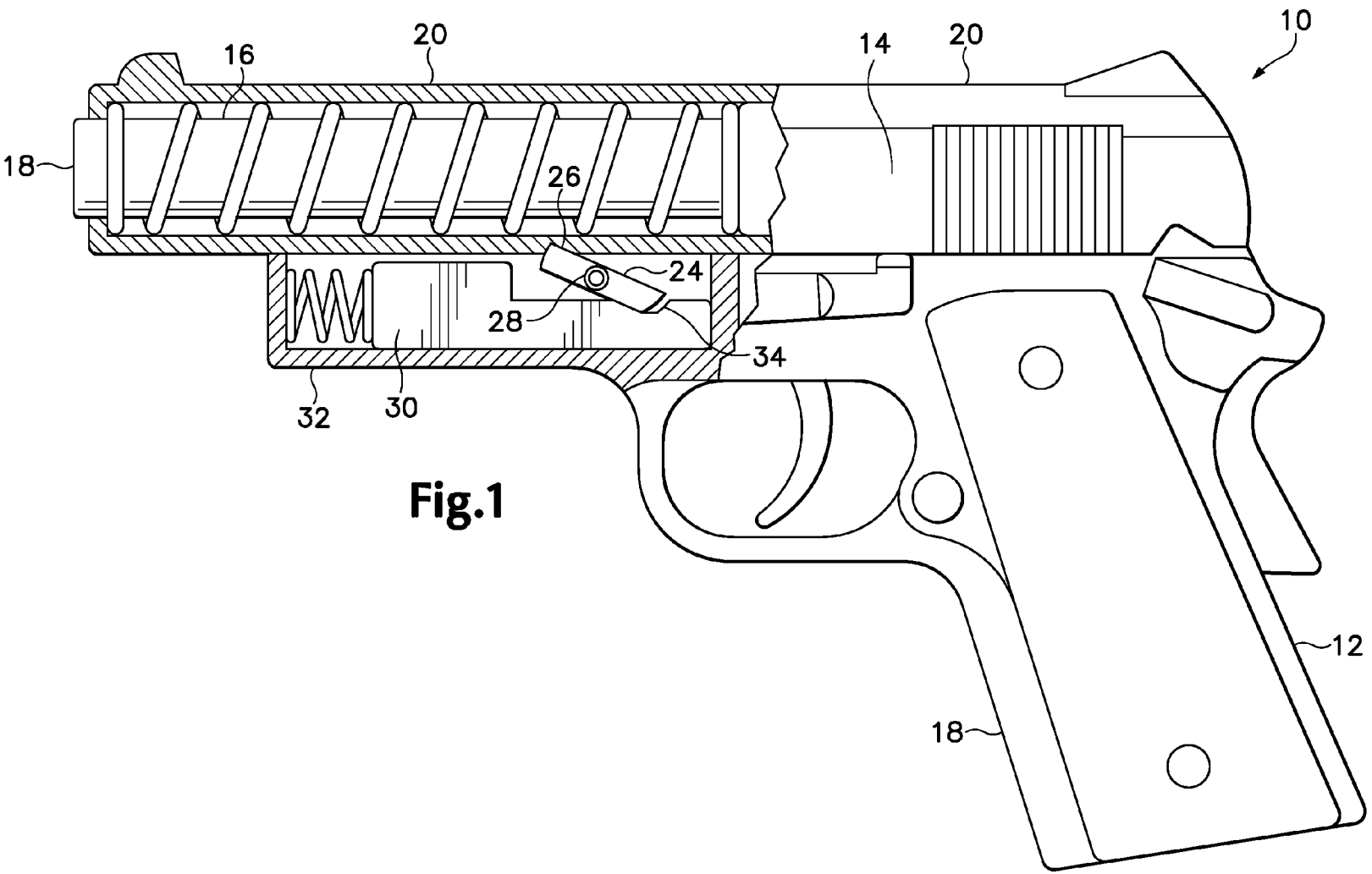
FIG. 1 is a side, partial cut-away, view of a firearm constructed according to the present invention, shown in a first, ready state.

Referring to FIG. 1, a firearm 10 constructed according to the present invention includes a handgrip 12, a firing chamber 14, and a barrel 16. The handgrip 12 and barrel 16 form a portion of a first part 18, which engages with a second part 20 that is in the form of a slider. Second part 20 includes the breech block face and is generally locked to the first part 18, but is briefly unlocked and permitted to translate relative to first part 18, shortly after firearm 10 is fired, as will be described below.

Figure 2:
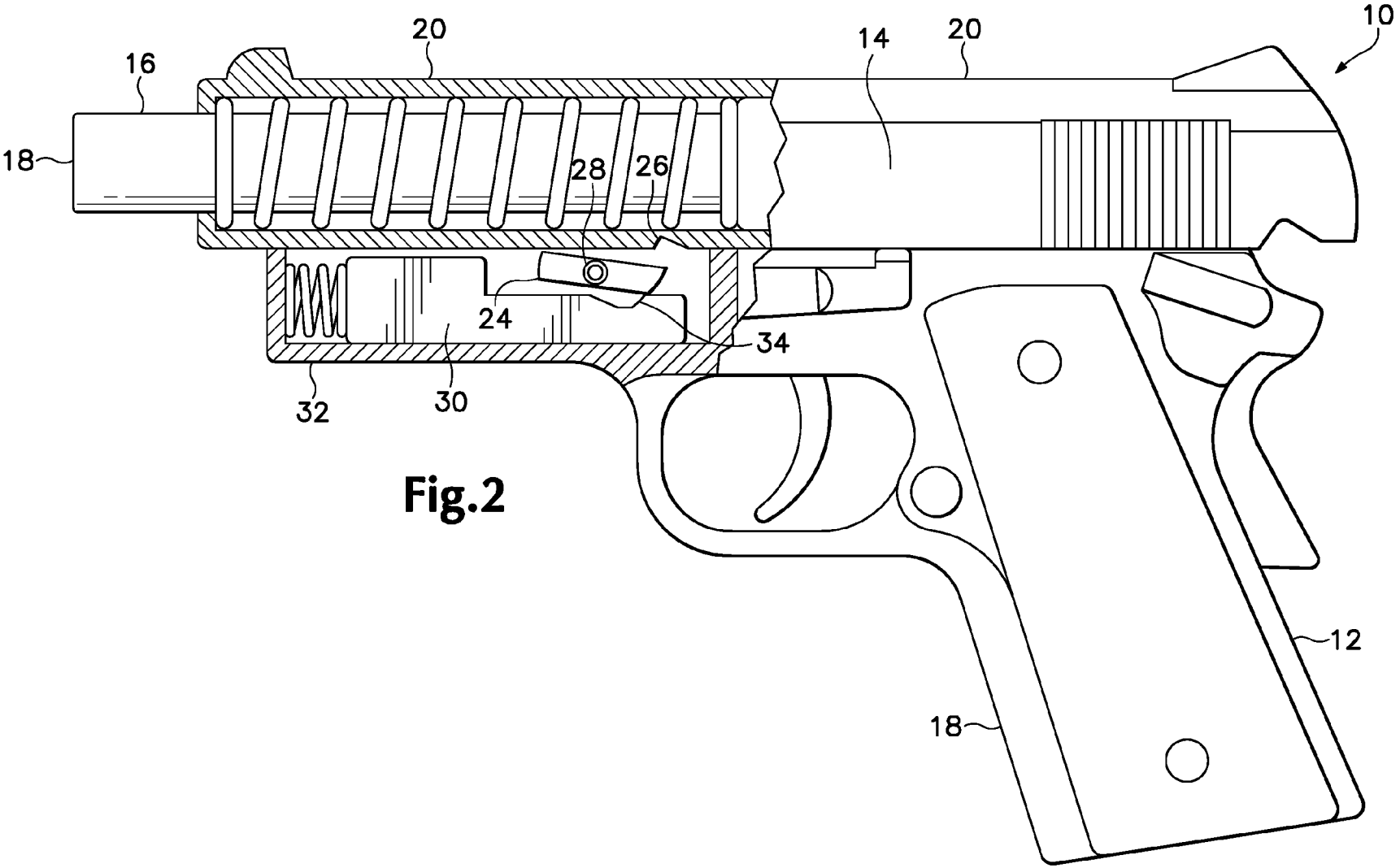
FIG. 2 is a side, partial cut-away, view of the firearm of FIG. 1, in a second state, which occurs shortly after being fired.

To maintain first part 18 and second part 20 in locked relationship, a locking piece 24 is mounted on first part 18 and urged into locking contact with a notch 26 defined in second part 20, by a spring 28, mounted in first part 18. Referring also to FIG. 2, when the firearm 10 is fired, an inertial piece 30 that is retained by a recess wall 32, retains its position as the remainder of firearm 10 is accelerated in a rearward direction. Locking piece 24 and inertial piece 30 are shaped so that as locking piece 24 moves to the rear, it contacts a slope 34 of inertial piece 30, which acts to rotate piece 24, thereby moving piece 24 out of engagement with notch 26. This unlocks first part 18 from the second part 20, which permits first part 18 and second part 20 to move relative to each other, permitting the spent cartridge case to be ejected and a new cartridge to be placed into the firing chamber 14, by mechanisms otherwise well known to skilled persons. It takes an operator a time period on the order of a second to bring the backward motion of a firearm (such as firearm 10) to a stop. But the release of part 20 from part 18 must be delayed by about 20 milliseconds to permit the bullet to leave the barrel 16. Consequently, part 20 will slide backward relative to part 18 after being unlocked (at approximately a hundredth of a second after firing), because it is not being decelerated in rearward movement by the shooter's hand, as is part 18.

Those skilled in the art will appreciate that the design shown and described above yields great flexibility in the design of self-loading firearms. With the previous technology high intensity ordinance would cause the lock mechanism to unlock prematurely. With the design of firearm 10, however, the distance between the resting position of slope 34 and the position to which slope 34 must move to unlock piece 24 may be increased in order to adjust the period of the required delay, so that there is no escape of hot gasses. Moreover the barrel 16 is permanently and rigidly attached to handgrip 12, ensuring stability during firing.

Because of the design flexibility of a firearm designed according to the present invention, it is possible to design a relatively light weight, high intensity cartridge self-loading hand gun. Although a gas operated gun of this sort has been designed, it is very heavy. For example, with the previously available technology it would appear to be at least very difficult to make a practical and accurate self loading hand gun or pistol 10 having a 11.43 mm (0.45 in) caliber barrel and a mass of less than 0.75 kg.

In a preferred embodiment, inertial piece 30 has a mass of 75 grams and is positioned to travel 0.5 cm before slope 34 contacts locking piece 24 to begin the process of unlocking part 20 from part 18. In an alternative preferred embodiment inertial piece 30 has a mass of 50 grams, and is similarly positioned to travel 0.5 cm, or in another alternative 0.75 cm, before slope 34 contacts locking piece 24. In a preferred embodiment inertial piece 30 has a mass of greater than 10 grams, and in another preferred embodiment inertial piece 30 has a mass of greater than 20 grams.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow.

In an alternative preferred embodiment firearm 10 takes the form of a rifle. In an additional alternative preferred embodiment, firearm 10 takes the form of a shotgun.

The invention claimed is:

1. A self-loading firearm, having a front from which a bullet exits when fired, and comprising:

(a) a unitary portion, including a human interface and a barrel;

(b) a moveable portion attached to said unitary portion so as to permit said moveable portion to move relative to said unitary portion, said moveable portion including at least a portion of a firing chamber;

(c) a lock adapted to selectably fix in place said moveable portion relative to said unitary portion;

(d) a recess defined by said unitary portion; and (e) an inertial member permitted to move inside said recess and urged into a first position in which said lock is maintained in a position fixing in place said moveable portion relative to said unitary portion, said inertial member adapted to translate into a second position displaced toward said front of said firearm from said first position by at least 0.1 cm, upon firing of said firearm, in which said second position said inertial member begins to change the position of said lock, thereby permitting said moveable portion to move relative to said unitary portion, after said lock has been moved sufficiently to unlock said moveable portion from said unitary portion.

2. The automatic firearm of claim 1, further being defined as a handgun and wherein said human interface is a handgrip.

3. The automatic firearm of claim 1, further being defined as a rifle and wherein said human interface is a shoulder stop.

4. The automatic firearm of claim 1, further being defined as a shotgun and wherein said human interface is a shoulder stop.

5. The self-loading firearm of claim 1, wherein said moveable portion hosts a resident cartridge and when fired ejects said resident cartridge upon moving relative to said unitary portion.

6. The self-loading firearm of claim 5, wherein said moveable portion may be loaded with a new cartridge after ejecting said resident cartridge.

7. The self-loading firearm of claim 1, wherein said moveable portion slides relative to said unitary portion.

8. The self-loading firearm of claim 7, wherein said gun barrel defines a longitudinal dimension and wherein said moveable portion slides in said longitudinal dimension defined by said gun barrel.

9. The self-loading firearm of claim 1 wherein said inertial member is sized and said first position is located, relative to said second position, so that high pressure gas present in said barrel of said firearm immediately after firing has substantially dissipated at the time said moveable portion is unlocked from said unitary portion.

10. The self-loading firearm of claim 1 wherein said inertial member is sized and said first position is located, relative to said second position, so that said moveable portion continues to have rearward momentum from cartridge firing at the time said moveable portion is unlocked from said unitary portion.

11. The self-loading firearm of claim 1, wherein said inertial member has a mass of greater than 10 grams.

12. The self-loading firearm of claim 1, wherein said inertial member has a mass of greater than 20 grams.

13. The self-loading firearm of claim 1, wherein said first position is displaced from said second position by at least 0.3 cm.

14. The self-loading firearm of claim 1, wherein said first position is displaced from said second position by at least 0.5 cm.

* * * * *